US005564293A

United States Patent [19]

Black et al.

[11] Patent Number: 5,564,293

[45] Date of Patent: Oct. 15, 1996

[54] PELT STRETCHER

[76] Inventors: Marshall R. Black, R.R. 2, Box 233; Danny D. Myers, R.R. 1, Box 76, both of Rockport, Ill. 62370

[21] Appl. No.: 455,036

[22] Filed: May 31, 1995

[51] Int. Cl.[6] ..... C14B 1/02; C14B 15/06

[52] U.S. Cl. ..... 69/19.2; 38/102

[58] Field of Search ..... 69/19, 19.1, 19.2, 69/19.3; 38/69, 70, 102

[56] References Cited

U.S. PATENT DOCUMENTS

| | | | |
|---|---|---|---|
| 752,950 | 2/1904 | Bowman . | |
| 962,391 | 6/1910 | Scott | 69/19.2 |
| 1,102,029 | 6/1914 | Fitzgerald | 69/19.2 |
| 1,169,145 | 1/1916 | Gibson | 69/19.2 |
| 1,398,907 | 11/1921 | Montgomery | 69/19.2 |
| 1,456,764 | 5/1923 | Corbin . | |
| 1,722,647 | 7/1929 | Vickrey | 69/19.2 |
| 1,954,697 | 4/1934 | Gibbs . | |
| 2,343,968 | 3/1944 | Fitzgerald . | |
| 3,301,028 | 1/1967 | Peradi | 69/19.2 |
| 4,381,654 | 5/1983 | Baldridge | 69/19.2 |
| 4,848,108 | 7/1989 | Thompson | 69/19.2 |

FOREIGN PATENT DOCUMENTS

| | | | |
|---|---|---|---|
| 75571 | 1/1918 | Switzerland | 69/19.2 |

*Primary Examiner*—Michael A. Neas
*Attorney, Agent, or Firm*—Joseph W. Holloway

[57] ABSTRACT

A V-shaped spring steel frame having depending legs coacts with a manually gripped, T-shaped pelt-drawing member that is longitudinally movable along the frame legs for forcibly stretching a fur pelt attached to the drawing member downwardly over the frame. The drawing member provides variable spacing between the frame legs, releasable locks for securing the member and the frame against relative longitudinal movement, and a sizeable flat handle to which portions of the pelt are removably secured during pelt stretching and drying.

5 Claims, 2 Drawing Sheets

PELT STRETCHER

BACKGROUND OF THE INVENTION

This invention generally relates to an improved stretcher for processing pelts of fur bearing animals such as raccoons.

The worth of a raw fur pelt is initially judged by the animal's size, maturity and condition at the time the pelt is taken. After a raw pelt has been fleshed, stretched and dried, its market value, i.e. the price paid to trappers, ranchers and hunters, is determined by the degree to which the pelt exhibits grade excellence or primeness in the opinion of pelt buyers such as dealers and furriers. Primeness, or lack thereof, reflects not only intrinsic pelt quality, but is based also on a subjective evaluation of these additional pelt attributes:

- Evidence of skillful and careful pelt preparation and handling;
- Surface smoothness and uniformity of each pelt from nose to tail and from side to side;
- Absence of hide or fur blemishes due to improper or incomplete drying; and
- Substantial uniformity in size and configuration among all pelts in any group of pelts being evaluated.

After the primeness or grade of a pelt has been established in light of the above-listed criteria, the price paid for an individual raccoon pelt, for example, is calculated having particular regard for the length of that portion of the pelt which is most valued by furriers and other customers, namely, an elongated portion of the pelt back which is relatively narrow and extends from just below the ears to the base of the tail. Obviously, it is of great importance to pelt suppliers that this price-determining back portion be stretched to as great a length as possible while maintaining a width insubstantially greater than that prescribed by buyers.

Historically, maximization of pelt length does not appear to have been a significant factor in the design and fabrication of pelt stretching devices since stretchers previously offered to the trade basically comprise a frame over which the green pelt is drawn into conformity with the general outline of the frame. Heretofore, efforts to optimize pelt elongation appear to have been frustrated by such unfavorable factors as the frame's excessive width; the low magnitude of longitudinal force that could be effectively applied to the pelt; and, the functional inadequacy of various means intended to maintain the hide in its stretched condition.

The type of stretcher most widely used at present is depicted in FIG. 1 and is described in detail hereinafter. Briefly, this popular stretcher comprises a round spring steel rod forming an elongated, three sided, closed frame comprising a slightly modified version of the frame disclosed in U.S. Pat. No. 1,456,764 issued to Corbin. According to Corbin, side-to-side pelt stretching results from the reaction of the diverging flexible legs of his frame to the lateral strain imparted thereto by drawing the pelt downwardly thereover. After a pelt is drawn firmly over the Corbin frame, toothed clips which slide freely along the frame legs and can be made to penetrate the lower portion of the pelt back and belly are pulled downwardly along the legs and frictionally engage the legs for holding the pelt in a stretched condition.

While the Corbin type stretcher of FIG. 1 is employed by many trappers and ranchers, this device has several recognized structural and operational shortcomings, namely:

1. The side-to-side spread of this stretcher construction is fixed and cannot be changed even though narrowing the stretcher width would create an opportunity to gain valuable pelt elongation.

2. The force that can be effectively applied to a pelt for beneficial elongation is significantly limited in two regards; firstly, by the strength and gripping ability of the individual user's fingers which he must use to pull Corbin's holding clips downwardly along the frame legs and secondly, by the total dependence on frictional resistance between the clips and legs to avert subsequent upward slippage of the clips. Moreover, the ability of the user to grip the clips and of the clips in turn to grip the legs may be substantially, if not totally, defeated by a coating of grease usually deposited on the clips and legs from the fatty hide of a green pelt.

3. A pelt holding clip of the Corbin type is typically fabricated by bending a stamped metal blank into a U-shaped channel and providing hide gripping teeth at one channel end and aligned leg-receiving apertures at the opposite end. After only a short period of wear and repeated stressing tending to twist the grip about its leg-penetrated end, the apertured end of the clip arm becomes permanently deformed thereby enlarging and distorting these apertures to such an extent that the clips can no longer grip the frame legs.

4. As best shown in FIG. 1, the Corbin clip points or teeth are insertable into the pelt hide near the base of the tail; and, no further provision is made for securing the tail in an open or spread condition. Consequently, the edges of the tail will usually curl inwardly whereby the moist hide inside the tail overlies itself and forestalls proper drying action by air circulating thereabout. In any area where a moist hide is permitted to overlie itself and to adhere to itself, rotting or other blemishing is inevitable and the pelt is degraded accordingly.

5. After a pelt is mounted upon a stretcher, it may be arranged on wires or racks with a sizeable number of other pelts in a suitable drying atmosphere. Prolonged contact between still moist pelts results in rot damage or blemishes. Since the Corbin-type stretchers do not incorporate means for avoiding pelt-to-pelt contact during such drying process, great care must be used initially to arrange the pelts with correct spacing there between, or some additional separating device must be provided. In either case costs related to the drying process are increased accordingly.

6. Users commonly stack or pile empty stretchers together between uses and find that it is difficult and hazardous to thereafter extract a Corbin-type stretcher from a tangled pile once its sharpened holding clips become interlocked or otherwise foul.

From the preceding recitation of specific problems and failures users of Corbin-type stretchers presently encounter, it will be apparent that an improved construction intended to supercede this troublesome, although popular, device should have at least these objectives and critical characteristics:

1. Stretcher width should be variable and presettable to comply with specifications dictated by pelt buyers.

2. The pelt-drawing member of the stretcher that is longitudinally shiftable relative to the stretcher frame should be located and be specially configured for ready and safe manual gripping so that tensile force applied to the drawing member will effectively achieve optimal pelt elongation and price realization.

3. Locking means for securing the drawing member to the frame should be operable after the pelt is stretched for maximum elongation at a preset width and should be positive, easy to apply and release, and operationally independent of whatever means is employed to preset variably the frame width and should provide compensation for wear between sliding stretcher parts 4. The drawing member should carry mounting means to which the pelt body as well as the spread tail can be readily secured and detached without undue risk of personal injury or pelt damage.

5. The stretcher should incorporate as one of its structural features suitable spacing means to facilitate air circulation between stretchers disposed adjacent one another during the pelt drying operation. Additionally the overall stretcher configuration should be such that empty stretchers can be piled or stacked together randomly without producing troublesome entanglement.

6. An improved stretcher should be simply and ruggedly built, uncomplicated in operation, and low in manufacturing cost.

Varible width stretchers with spaced legs connected by a tranverse pelt-drawing member movable relative to the legs are known in the art; and, a variety of such stretchers is disclosed in these prior U.S. patents:

| | | |
|---|---|---|
| 752,950 | Bowman | February 23, 1904 |
| 1,954,697 | Gibbs | April 10, 1934 |
| 2,343,968 | Fitzgerald | March 14, 1944 |
| 3,301,028 | Perardi | January 31, 1967 |

The aboveidentified patent to Gibbs and U.S. Pat. No. 4,848,108 issued to Thompson on Jul. 18, 1989, disclose stretchers having special tail holding members.

U.S. Pat. No. 4,381,654 issued to Baldridge on May 3, 1983, shows a common chain attached to the pelt-drawing cross member for manual application of tensile stress thereto.

The early Bowman patent disclosed the previously known stretcher construction of most interest; however, even if the Bowman teaching is given its broadest possible interpretation, it fails to suggust solutions to all of aforelisted problems with the Corbin-type stretcher.

SUMMARY OF THE INVENTION

A general object of this invention is to provide a pelt stretcher which meets modern standards and serves the economic needs of trappers, ranchers, hunters and others engaged in the business of buying and selling fur pelts.

Another general object is to provide a stretcher of the type under consideration which has been particularly designed to cure the recited shortcomings of the Corbin-type device shown in FIG. 1 of the attached drawings and to embody all of the critical stretcher characteristics listed above.

A more specific object is to provide a stretcher having means for establishing a presettable width across the pelt back wherein the means also serves to anchor the pelt and to draw it longitudinally on the stretcher to a desire length.

Another specific object is to provide a pelt stretcher having a pair of longitudinally extending and laterally diverging legs which are transversly connected by a T-shaped pelt drawing member which is slidably supported on the legs. A specific feature of the drawing member is a handle portion which extends between the legs and affords the stretcher user easy access and a secure manual grip.

An improved structural feature of the invention is a T-shaped pelt-drawing member provided with a handle portion over which the pelt tail can be spread for removably anchoring the same thereto by pointed means extending through the tail and into the handle itself.

A still more detailed object is to prevent unwanted slippage between the pelt-drawing member and the diverging frame legs. To this end, threaded eyebolts are received in and advanced through complementary threaded apertures in the drawing member into compressive engagement with the legs. Even after substantial wear due to prolonged usage, the legs can be positively wedged against the drawing member simply by forcibly advancing the bolts further into the threaded apertures.

A further aspect of this invention is the provision of locking means between the frame legs and slidable drawing bar of a pelt stretcher which means are elongated and project in a generally perpendicular manner from the plane of a stretched pelt. The projecting locking means provide positive spacing between adjacent stretchers closely hung on a drying rack or the like; and, only the extreme end surfaces of the locking means ever touch an adjacent pelt during the drying process, therefore, obstruction of beneficial interpelt air circulation is negligible.

An unexpected benefit prospectively available to current users of vast numbers of Corbin-type stretchers is that their spring steel frames can be easily modified as hereinafter indicated to coact with the improved pelt-drawing member herein disclosed. Since this major stretcher component can be salvaged, the cost of obtaining a substantially improved and modernized stretcher is reduced accordingly.

These and other advantages and objects of this invention and the manner of obtaining them will become apparent and the invention will be best appreciated and fully understood by having reference to the following detailed description of the invention taken in conjunction with the accompanying drawings.

DETAILED DESCRIPTION OF THE DRAWINGS

DETAILED DESCRIPTION OF THE INVENTION

Figure 1:
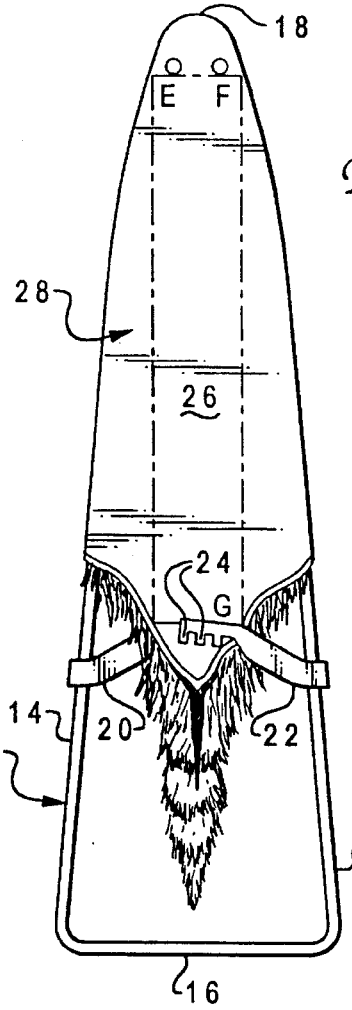
Fig. 1 Prior Art
FIG. 1 is a plan view showing the back portion of a raccoon pelt fully stretched for drying on a prior art device made substantially in accordance with Corbin Patent 1,456,764.

As stated above in connection with the background of this invention, the stretcher frame indicated generally by numeral 10 in FIG. 1 is a modification of the stretcher disclosed in U.S. Pat. No. 1,456,764 issued to Corbin. It is estimated that as many as one million of this type of pelt stretcher are in active use. Stretcher frame 10 is made by bending a thin spring steel rod into an elongated, triangular shape defined by legs 12 and 14 and a transverse base 16. The legs diverge from the frame apex 18 and have lower end segments which are bent toward one another and are joined together by any suitable means to form the base 16. The frame legs are somewhat flexible and resilent, but the lateral spacing of these legs is fixed and cannot be changed or preset. A pair of pelt holding clips 20 and 22 are constructed and employed with stretcher 10 in a manner identical to that disclosed in the cited Corbin patent. The clips have sharp teeth 24 extending from their inner ends for penetrating engagement with the back 26 and belly, not shown, of the exposed hide side of a pelt 28 mounted on stretcher 10. The outer ends of the clips 20 and 22 are transversly apertured for slidably receiving therethrough the frame legs 12 and 14, respectively.

After a green pelt 28 is turned hide side out and is drawn down over the frame apex 18 so that the back and belly portions of the pelt extend laterally across the frame, the pelt holding clips 20 and 22 are positioned on the legs 12 and 14, respectively, in substantial transverse alignment with the lower portion of the pelt. The sharp teeth 24 extending from the inner ends of the clips are then thrust into opposed sides of the hide as near as possible to the longitudinal centerline of the pelt; and, the clips are drawn downwardly along the legs to the full extent the user's grip and finger strength will allow. Thereafter, the arms of the clips will be biased by the resilience of the pelt upwardly about their apertured outer ends causing the clips to cock or twist with respect to the cylindrical surfaces of the legs. In this cocked condition, it is the intended that the resulting frictional resistance to slippage between the clips and the legs will exceed the reactive upward pull created by the resiliency of the stretched pelt.

Due to the substantial divergence of the legs 12 and 14, the pelt 28 will stretch simultaneously laterally and longitudinally in response to drawing the pelt down over the frame 10. Even though the pelt 28 is somewhat elastic in its green or moist condition and can be widened and elongated, any increase in pelt length obtainable at the expense of diminished pelt width will be limited due to the configuration and method of operation of this kind of stretcher. This practical limitation on achievable elongation is caused by the substantial initial width of the frame base 16 which, in turn establishes a proportionally wide pelt spread between the legs 12 and 14, by the pelt's increased resistance to lateral deformation as the clips are pulled downwardly, and by the user's inability to apply a substantial drawing force to the clips using his fingers alone.

Figure 2:
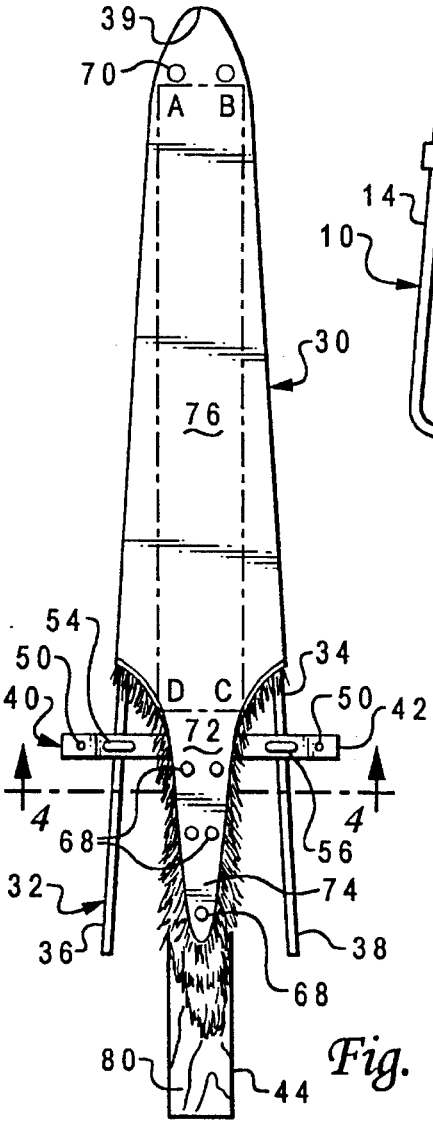
FIG. 2 is a plan view of the back portion of a raccoon pelt fully stretched on the stretcher construction disclosed herein.
Figure 3:
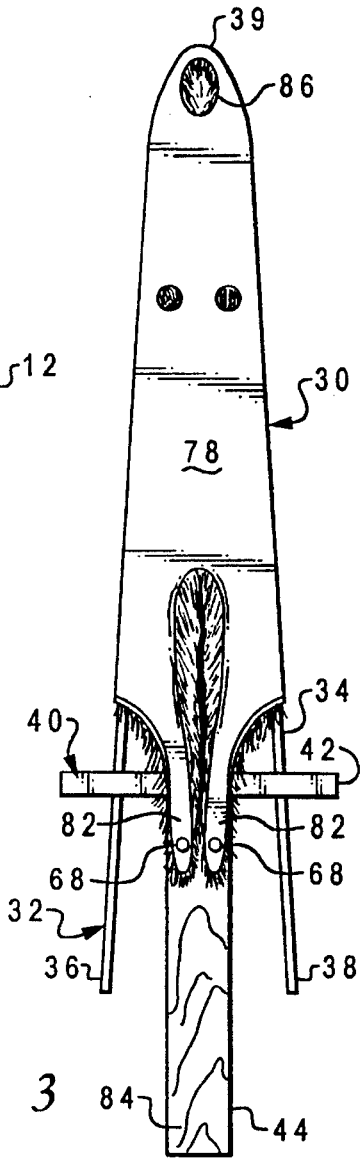
FIG. 3 is a plan view of the belly portion of pelt and stretcher shown in FIG. 2.

Turning now to the present invention, FIGS. 2 and 3 depict a raccoon pelt 30 like pelt 28 shown in FIG. 1 taken from a nearly identically sized animal. Pelt 30 is shown in a fully stretched condition on a stretcher 32 which includes a V-shaped frame 34 made by bending a length of spring steel rod. The frame's legs 36 and 38 form an apex 39 and depend therefrom in an unconstrained, diverging manner. The leg portions 12 and 14 of frame 10 of the stretcher shown in FIG. 1 can be conveniently employed with stretcher 32 once the base member 16 and small connecting curved portions of the legs 12 and 14 are removed by a simple cutting or sawing operation.

A key structural feature of this invention is a pelt-drawing member indicated in its entirety by numeral 40. As best shown in FIGS. 2 and 3, drag member 40 is T-shaped wherein the top of the T comprises a elongated slide bar 42 and the upright leg of the T comprises a similarly elongated handle means 44 depending from the slide bar 42. The bar 42 could be made of wood or plastic, however, a stronger, more durable material such as steel is preferred. The illustrated bar has a square cross section and may be made from either solid or tubular stock. The length of the bar should be somewhat greater than the widest anticipated spread between legs 36 and 38 that may be required to provide the desired width at the base of the pelt 30.

Figure 4:
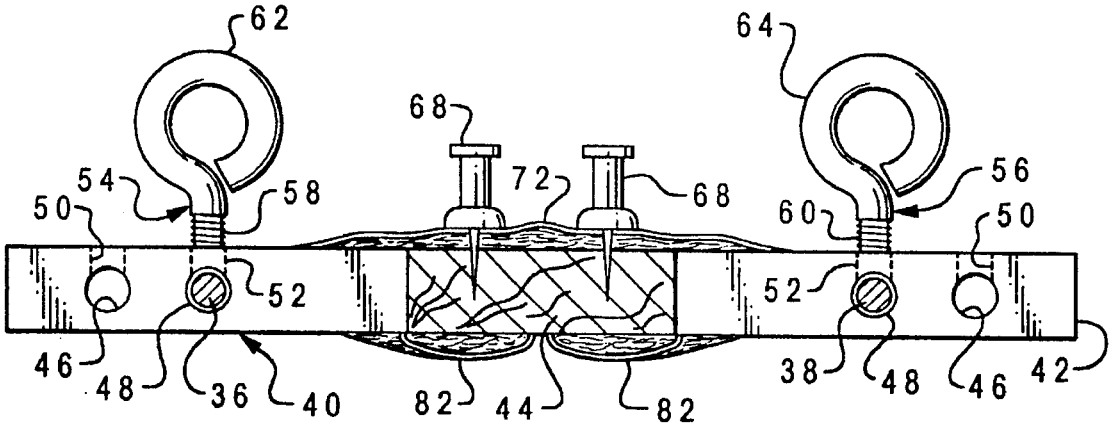
FIG. 4 is an enlarged sectional view taken along line 4—4 of FIG. 2; and, FIG. 5 is a fragmentary bottom view of FIG. 4 with the pelt shown in FIG. 4 being detached therefrom.
Figure 5:
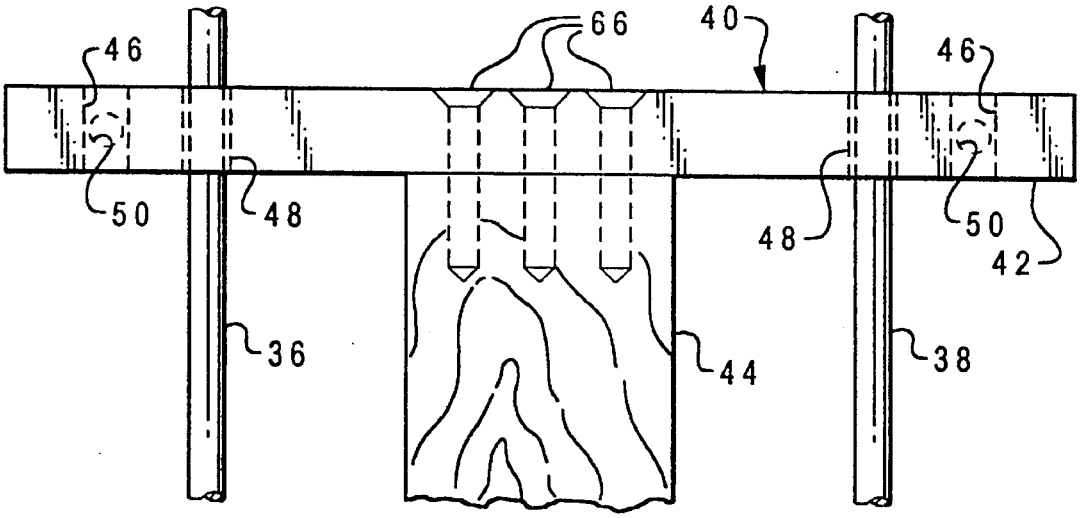

As best shown in FIGS. 4 and 5, the slide bar 42 is drilled through from side to side to provide a set of outer bores 46 near the bar's opposite ends and a set of inner bores 48 spaced laterally inwardly from the bores 46 toward the longitudinal centerline of stretcher 32. The bores 46 and 48 have an inside diameter which exceeds somewhat the outside diameter of the frame legs 36 and 38 so that the bores may receive the legs freely and the bar 42 can slide therealong in spite of unavoidable axial misalignment of the bores with the diverging legs. Extending downwardly from the top surface of slide bar 42 and opening respectively to the midpoint of each of the bores 46 and 48 are threaded recesses 50 and 52. FIG. 4 shows a pair of identical eyebolts 54 and 56 having elongated shanks 58 and 60 which are threaded for complementary engagement with the threads presented by any of the recesses 50 and 52. The eyebolts have enlarged, generally circular heads 62 and 64 which can be convienently digitally engaged and turned for advancing the extreme lower end of threaded shanks 58 and 60 with great force into compressive locking engagement with the legs 36 and 38.

While only two sets of bores 46 and 48 are illustrated and described herein, it is apparent that the slide bar 42 could be provided with additional sets of bores and that the spacing between bores can be varied to space the legs 36 and 38 as desired.

To cure a shortcoming of the Corbin stretcher, this invention provides a pelt-drawing member 40 having a readily grippable handle portion 44 by means of which the user can impart a powerful tensile force to the slide bar 42. Handle 44 extends perpendicularly from the middle of the slide bar 42 and depends therefrom between the legs 36 and 38 which are spaced by the slide bar. In the preferred form illustrated in the attached drawings, the handle comprises an elongated shaft with an upper end surface abutting the flat bottom side of the slide bar 42. These components of the drawing member 40 are held in attached relation to one another by threaded fasteners 66 which penetrate predrilled bores through the midsection of the slide bar and then screw into the upper end of the handle. The handle is shown with a rectangular cross section and flat side walls for ease of manufacture; however, the handle could be shaped in any manner to enhance gripping by a user.

It is essential to the operation of this invention that the pelt 30 can be securely attached to the T-shaped member 42; and, to this end, the pelt-drawing handle 44 is made of wood or plastic material into which common push pins or staples can be readily set and removed. As depicted in FIGS. 2, 3 and 4 of the drawings, several plastic or metal headed push pins 68 have had their pointed shafts pressed through the pelt 30 at selected locations into the wooden handle 44 a sufficient distance to prevent unintentional pelt detachment as the handle is drawn downwardly along the stretcher legs. Any type of wire staples set by means of a stapling gun or the like could also be utilized for pelt attachment to handle 44.

OPERATION OF THE DISCLOSED EMBODIMENT

One key to achieving well-managed pelt stretching through the use of this invention is the preselection of a pair of the illustrated sliding bar bores 46 or 48 which produces the least lateral divergence between legs 36 and 38, but, nevertheless, provide enough lateral stress in a green pelt of given size to assure side-to-side hide smoothness when the pelt is fully drawn. The selection of both bores 48 to receive legs 36 and 38 sets the legs at their closest spacing as shown in FIGS. 2 and 3. Two. successively wider spacings can be achieved by selecting one each of bores 46 and 48 or both bores 48, as desired. With experience, a user can make a proper bore selection for green pelts of different sizes and shapes with speed accuracy.

As noted above, pelt buyers highly value that elongated prime portion of the pelt back extending from just below the ears 70 to a point near the base 72 of the tail 74. This generally rectangular pelt area is indicated in phantom lines in FIG. 2 by letters ABCD, the width of this area being AB and its fully stretched length being AD. For a mature raccoon of average size the leg spacing AB just below the pelt ears 70 is approximately four inches. In keeping with the requirements of pelt buyers that the prime back area be in the general shape of an elongated rectangle, the leg spacing dictated by whichever combination of bores 56 and 58 is selected should produce well-managed lateral stretching across the tail base 72 wherein the pelt width at CD is substantially the same as at AB when pelt length AD is at its greatest.

After the legs have been inserted through the selected bores in the slide bar 42, the pelt 30 is loosely dressed over the legs 36 and 38 with the back side 76 lying on that side of the stretcher from which the eyebolts 54 and 56 project and with the belly side 78 lying on the opposed side of the stretcher as shown in FIG. 3. With the T-shaped drawing member 40 positioned so that the tail 74 overlies the wide side 80 of the handle 44 and the depending leg portions 82 of the pelt overly side 84 of the handle, these tail and leg portions are removably secured to the handle by means of a plurality of push pins 68 at the several points indicated in the drawings. It will be appreciated that the substantial size of the depending handle 44 provides not only a strong and effective means for applying great tensile force to the pelt during drawing, but also functions as a base upon which the tail 74 can be juxtaposed, spread and secured in its fully open and extended condition in the manner shown in FIG. 2. This is to be compared favorably with the curled and rot-susceptable tail of pelt 28 depicted in FIG. 1.

Once the gristly head portion 86 of pelt 30 is placed in overlying relation to the apex 39 of the V-shaped stretcher frame 34 and the pelt tail 74 and legs 84 are pinned to the handle 44, the apex 39 is secured to a stationary hook or like member, not shown; and, thereafter, the handle is manually grasped and pulled downwardly between legs 36 and 38. Experimentation shows that a tractive force on the order of 30 and 40 pounds is required, in the case of a raccoon pelt, to reach a maximum pelt length AD of approximately 27.5 inches while preserving pelt width CD of approximately 4 inches. This compares vary favorably with the final dimensions of the portion of pelt back 26 shown in FIG. 1 in phantom lines where the greatest digital pull that could applied to the clips 20 and 22 without tearing the pelt hide produced a width EF which equalled width AD, but a final length FG of only approximately 23.5 inches. Such greater pelt elongation provided by a stretcher according to this invention produces a significant increase in market value of about 17 per cent. While this economic advantage alone provides an adequate incentive for trappers, ranchers and hunters to convert their Corbin-type stretchers for operation in accordance with this invention, other practical advantages also prompt such a decision.

As noted above, primeness, hence value, of all pelts in a batch of dried pelts is enhanced if substantial uniformity of pelt size and shape is afforded to buyers. To this end, this invention offers those opportunities for careful management of the stretching and drying operation:

1. By means of the handle 44, the user can apply tensile force directly in line with the pelt centerline for elongating the pelt, and for thereafter carefully adjusting and maintaining a desired final pelt length AD before the slide bar 42 is secured by eyebolts 54 and 56.

2. All pelts can be similarly stretched for smoothness and homocentricity by guiding the handle 44 evenly between the legs 36 and 38 during pelt drawing and by thereafter retaining this even spacing of the handle between the legs when the eyebolts 54 and 56 are tightened to lock the slide bar 42 to the legs.

3. The dried pelt tails will all be fully spread and extended and their hide sides will be free of blemishes due to improper drying.

The threaded eyebolts 54 and 56 will compensate for unavoidable wearing of the legs 36 and 38 merely by advancing them somewhat deeper into the threaded recesses 50 or 52. A failure to anticipate the need for wear compensating locking means for their pelt-drawing means creates a risk of early failure of stretchers of the type shown in the Corbin and Bowman patents. It is also important for correct and efficient operation of the hereindisclosed stretcher 32 that the efficacy of the eyebolts employed for locking the pelt drawing member 40 does not depend upon reactive lateral tension in the pelt as do the Corbin and Bowman devices. Moreover, the eyebolt locking means can be released without disturbing a previously preset lateral spacing between the legs 36 and 38. An unexpected advantage made available by the enlarged eyebolt heads 62 and 64 which serve as efficient finger grips is that these projecting but rounded heads also provide interpelt spacers or bumpers which facilitate beneficial air circulation between pelts suspended on drying racks in close proximity to neighboring stretchers.

The foregoing description of the embodiment of the invention shown in the drawings is illustrative and explanatory only; and, various changes in the size, shape and materials, as well as in specific details of the illustrated construction, may be made without departing from the scope of the invention. Therefore, we do not intend to be limited to the detail shown and described herein, but intend to cover all changes and modifications which are encompassed by the scope and spirit of the appended claims. For example, the size of stretcher components could be changed dramatically from those required for processing raccoon pelts to provide modified versions of the illustrative stretcher 32 best suited for smaller animals such as mink or for larger animals such as wolves.

It may be desirable to make the T-shaped pelt drawing member 40 in one piece from a suitably strong and machinable plastic material.

What we claim as our invention is:

1. In a pelt stretcher having laterally spaced legs upon which a pelt is mountable with an end thereof attached to drawing means slidable along said legs to effect longitudinal pelt stretching, the improved drawing means comprising:

a slide member disposed transversly of said legs and receiving said legs therethrough for relative longitudinal movement;

said slide member having laterally spaced bores therethrough and said legs being insertable through said bores to preset the spacing between said legs;

locking members for said slide member insertable into said bores into compressive engagement with said legs;

an elongate handle member projecting outwardly from said slide member in underlying juxtaposition with said pelt end; and, pointed members cooperable with said handle member for removably attaching said pelt thereto.

2. The drawing means defined in claim 1, wherein:

said slide member member projecting in direction of longitudinal pelt stretching and said handle member are joined to form a T-shaped member.

3. The drawing means define in claim 1, wherein:

said bores are laterally aligned with threaded openings in said sliding member which extend at right angles to said bores.

4. The drawing means defined in claim 3, wherein:

said locking means comprise elongated shafts extending from said sliding member and having enlarged heads at their distal ends and threads at their other ends cooperable with the threads in said openings.

5. The drawing means defined in claim 4, wherein:

said locking means comprise eyebolts.

* * * * *

UNITED STATES PATENT AND TRADEMARK OFFICE

CERTIFICATE OF CORRECTION

PATENT NO. : 5,564,293

DATED : October 15, 1996

INVENTOR(S) : M. Black and D. Meyers

It is certified that error appears in the above-indentified patent and that said Letters Patent is hereby corrected as shown below:

Column 9, lines 1-4, claim 2, should read:

Claim 2 The drawing means defined in claim 1, wherein: said slide member [member projecting in direction of longitudinal pelt stretching] and said handle member are joined to form a T-shaped member <u>with said handle member projecting in the direction of longitudinal pelt stretching.</u>

Signed and Sealed this

Twenty-first Day of January, 1997

*Attest:*

*Attesting Officer*

BRUCE LEHMAN

*Commissioner of Patents and Trademarks*